US005558137A

United States Patent [19]

Futerman

[11] Patent Number: 5,558,137

[45] Date of Patent: Sep. 24, 1996

[54] CONTAINER BAG FOR A CLOSED FILL SYSTEM

[75] Inventor: Charles S. Futerman, Stoke-On-Trent, England

[73] Assignee: Mulox IBC Limited, London, England

[21] Appl. No.: 377,944

[22] Filed: Jan. 25, 1995

Related U.S. Application Data

[63] Continuation-in-part of Ser. No. 117,732, Sep. 7, 1993, abandoned.

[30] Foreign Application Priority Data

Sep. 8, 1992 [GB] United Kingdom ..... 9218970

[51] Int. Cl.[6] ..... B65B 31/00

[52] U.S. Cl. ..... 141/44.000; 141/114; 141/68; 141/313; 141/48; 383/100; 383/103; 137/587

[58] Field of Search ..... 141/114, 59, 68, 141/325, 326, 313, 314, 315, 10, 93, 44–46, 48, 50; 383/100, 103; 137/587

[56] References Cited

U.S. PATENT DOCUMENTS

| | | | |
|---|---|---|---|
| 1,437,876 | 12/1922 | Tyler | 141/45 |
| 3,905,410 | 9/1975 | Arato | 383/103 |
| 3,918,502 | 11/1975 | Kline | 383/103 |
| 3,949,934 | 4/1976 | Goglio | 229/62.5 |
| 3,951,284 | 4/1976 | Fell et al. | 214/152 |
| 3,996,975 | 12/1976 | Hansel | 141/45 |
| 4,182,386 | 1/1980 | Alack | 141/93 |
| 4,653,661 | 3/1987 | Buchner | 383/103 |
| 4,676,284 | 6/1987 | DeCrane | 141/114 |
| 4,691,371 | 9/1987 | Derby | 383/62 |
| 4,703,517 | 10/1987 | Marino | 383/7 |
| 4,872,493 | 10/1989 | Everman | 141/114 |
| 5,183,086 | 2/1993 | Fanta et al. | 141/10 |

FOREIGN PATENT DOCUMENTS

| | | |
|---|---|---|
| 0635439 | 5/1994 | European Pat. Off. . |
| 0441720 | 1/1991 | France . |
| 1591091 | 1/1978 | United Kingdom . |
| 2063816 | 12/1980 | United Kingdom . |
| 2185732 | 7/1987 | United Kingdom . |

*Primary Examiner*—Henry J. Recla
*Assistant Examiner*—Steven O. Douglas
*Attorney, Agent, or Firm*—Kohn & Associates

[57] ABSTRACT

A container bag (10 designed to be inflated before or during filling characterized in that a pressure relief valve (22) is incorporated or incorporatable into the bag body, the valve being connectible to a receiver for exhausted powder or pulverulent matter. The pressure relief valve can be set to give a desired inflation pressure in the FIBC but will permit air to escape above this pressure thereby ensuring that the stitching and seams of the FIBC are not over-stressed to the point of leakage. The valve is connectible to, and preferably is connected to, a receiver for any vented gases and entrained powder. Preferably the receiver is the filling silo (28) so that any expelled powder is returned for refilling.

9 Claims, 3 Drawing Sheets

CONTAINER BAG FOR A CLOSED FILL SYSTEM

RELATED INFORMATION

This patent application is a continuation-in-part of copending U.S. application Ser. No. 117,732 filed on Sep. 7, 1993, now abandoned.

TECHNICAL FIELD

The field of this invention relates to container bags and in particular relates to container bags for carrying loads in the range of one half to two tons and known as flexible intermediate bulk containers (FIBC's).

BACKGROUND OF THE DISCLOSURE

Flexible intermediate bulk containers are increasingly employed in cargo handling and transporting situations, especially for the carriage of particulate or pulverulent material. A typical FIBC is manufactured from a fabric woven from a polyolefin tape and have integral lifting loops. Examples of such containers are described in UK patent numbers 1591091 and 1063816. FIBC's have to meet various national and international safety standards; for example it is normal to require a five to one safety ratio, that is, an IBC rated at one ton should not break under loads of less than five ton.

A recent trend in the FIBC field has been the increasing usage of extrusion coated fabrics in the manufacture of FIBC's to give moisture resistance without the requirement of a separate polyethylene liner. Extrusion coated FIBC's are not completely waterproof owing to the holes created by needle penetration during sewing in making up. However, designs for extrusion coated FIBC's have been proposed wherein very fine threads are employed and stuffer threads are used to fill the needle holes thereby giving much improved resistance to the passage of air, water or vapor.

More and more users are inflating the FIBC's prior to filling which is good practice to ensure even filling. For various reasons some users are inflating FIBC's to very high pressures and, in the absence of a polythene liner, the pressurized air can force its way through the finest of stitching and, where the filling product is a fine powder, entrained powder can be taken through with the air thus affecting the environment in the region of the filling machines. This is a specially acute problem where the contents are chemicals or fertilizers which may be noxious or otherwise harmful.

What is need is to provide a container bag and fill system to ameliorate the above cited problems.

SUMMARY OF THE DISCLOSURE

According to the present invention there is provided a fill system for a container bag designed to be inflated before or during filling characterized in that a pressure relief valve is incorporated or incorporatable into the bag body, the valve being connectible to a receiver for exhausted powder or pulverulent matter. The receiver for exhausted powder or pulverulent matter. The receiver is closed from ambient atmosphere. In one embodiment the receiver is a supply chamber that supplies the pulverulent material to the container bag. The supply chamber is also closed off from ambient atmosphere.

The pressure relief valve can be set to give a desired inflation pressure in the FIBC but will permit air or gas to escape the bag above this pressure thereby ensuring that the stitching and seams of the FIBC are not over-stressed to the point of leakage. However, the escape gas does not enter ambient atmosphere but is cycled back to the supply chamber. The valve is connectible to, and preferably is connected to, a receiver for any vented gases and entrained powder. Preferably the receiver is the filling silo so that any expelled powder through the valve is returned for refilling.

The pressure relief valve can be located anywhere on the FIBC but ideally is positioned on the top edge either along the edge where the top is attached to the body of the FIBC or in one of the corners of the top edge, for the convenience of attaching the tube thereto to lead vented gases and any entrained powder to the receiver. The pressure relief valve can be of various types as conventionally known and can be either sewn in, welded or glued into the fabric.

In an alternative construction, the valve is present on a tube or the like associated with the filling machine, and the FIBC is simply provided with means connectible to the valve, e.g. a disc or other area capable of receiving the valve. In this way the number of valves required is greatly reduced. The tube extends from the bag to the supply chamber.

The FIBC of the invention may be otherwise any of the conventionally known types but will normally be extrusion coated to render it air or water tight. The invention is equally applicable to FIBC's having or not having a liner e.g. of polyethylene sheet material.

The fabric from which the FIBC of the invention is formed may be a conventional fabric for use in this type of container and may be woven from polyethylene or polypropylene tape yarns or polyester coated yarns. The side walls of the container may be made from a fabric having reinforced zones or areas of interwoven reinforcing yarns for example as disclosed in our UK patent number 1591091 to which the lifting loops will normally be attached. The lifting loops will preferably be of a woven webbing of synthetic yarns, for example of the type used for car seat belts, for example polypropylene, polyamide or polyester yarns, or may be ropes or hawsers of suitable strength.

The system by being entirely sealed from the exterior ambient atmosphere keeps powder which may be toxic or otherwise environmentally unfriendly sealed in the system while the bag is being filled and simultaneously assuring that the bag retains its structural integrity during a pressure fill.

The container bag of the invention may be fitted with a top and a filling spout, as well as a discharge spout, as is conventional in the FIBC art.

BRIEF DESCRIPTION OF THE DRAWINGS

Reference now is made to the accompanying drawings in which.

DETAILED DESCRIPTION OF THE PREFERRED EMBODIMENT

Figure 1:
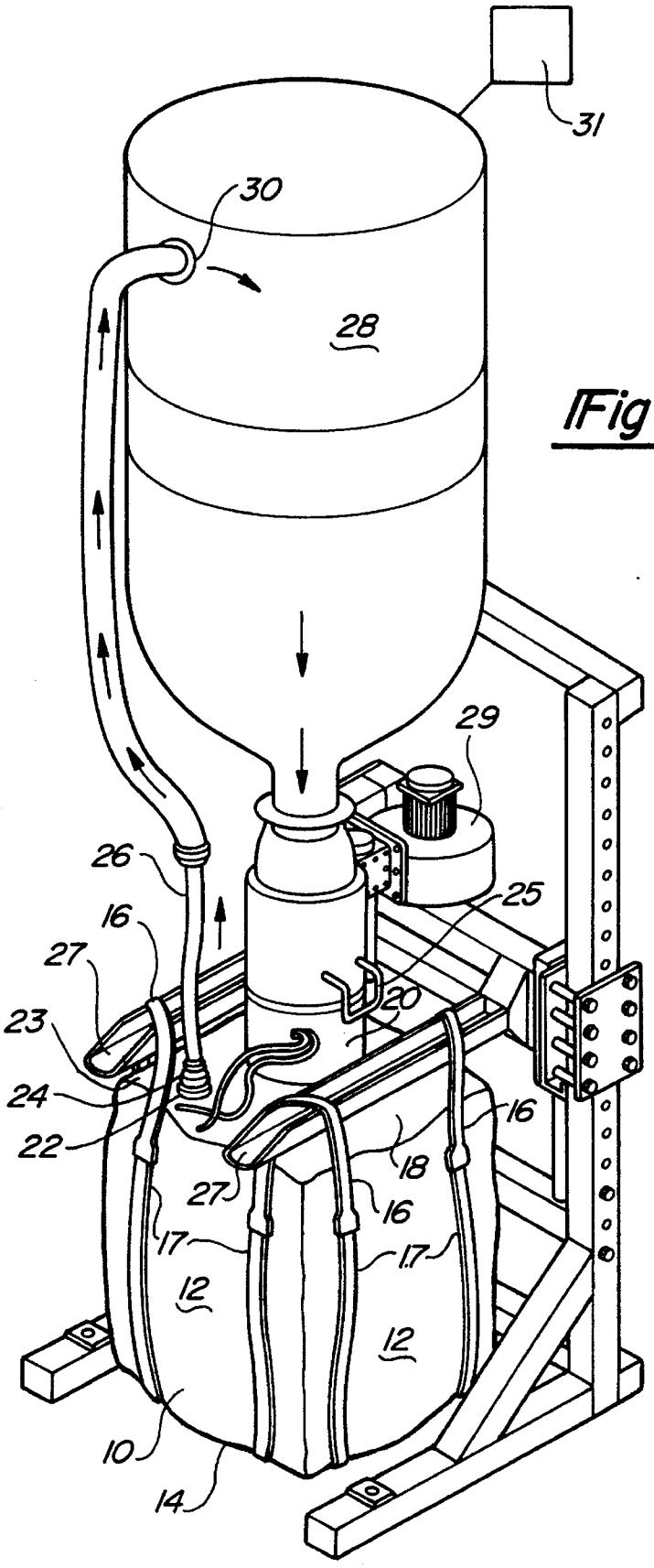
FIG. 1 is a perspective view of a closed filling apparatus incorporating an FIBC according to one embodiment of the invention.
Figure 2:
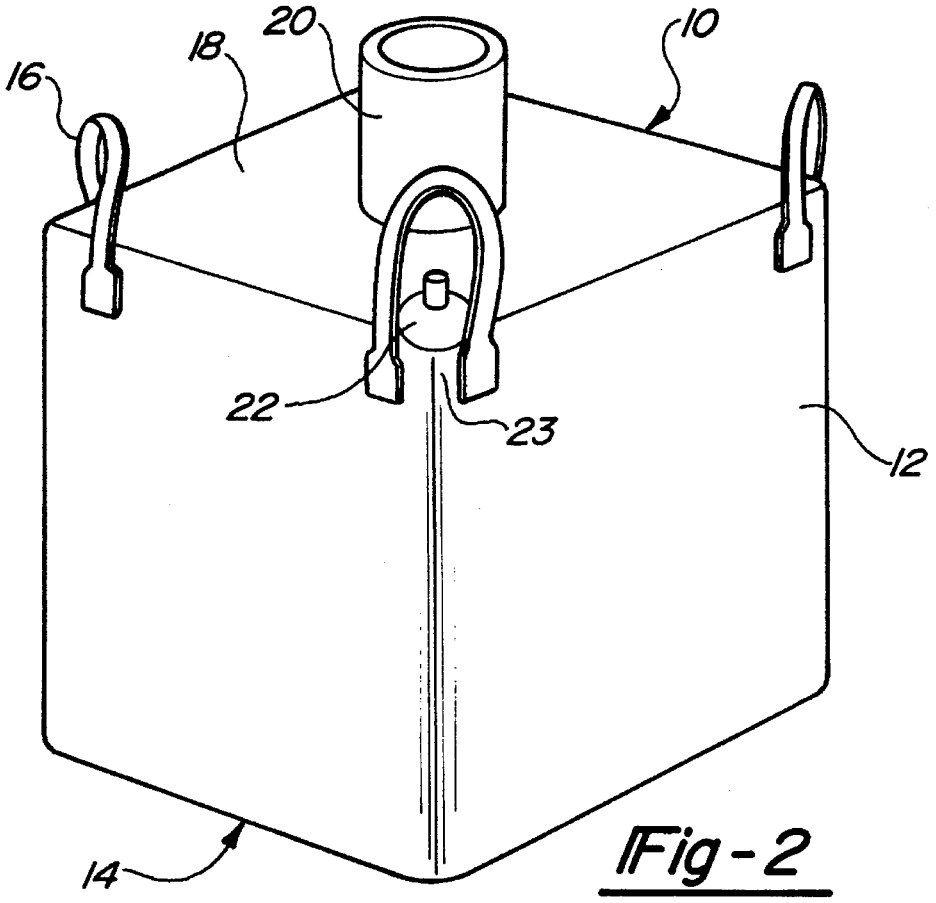
FIG. 2 is a perspective and schematic view of the FIBC shown in FIG. 1.

Referring to the drawings, an FIBC generally designated 10 has side walls 12 and a base 14. The fabric from which the side walls and base are formed will generally be a woven polyolefin fabric which has been extrusion coated to render it air and water resistant. Lifting loops 16 are provided across each corner and are stitched to respective side walls (which may contain reinforced zones 17 to which the lifting loops 16 are attached). The stitching is preferably carried out in such a way as to minimize leakage, e.g. by use of fine threads and stuffer threads.

The bag 10 has a top 18 with a filler spout 20 as is conventional in this field.

Figure 3:
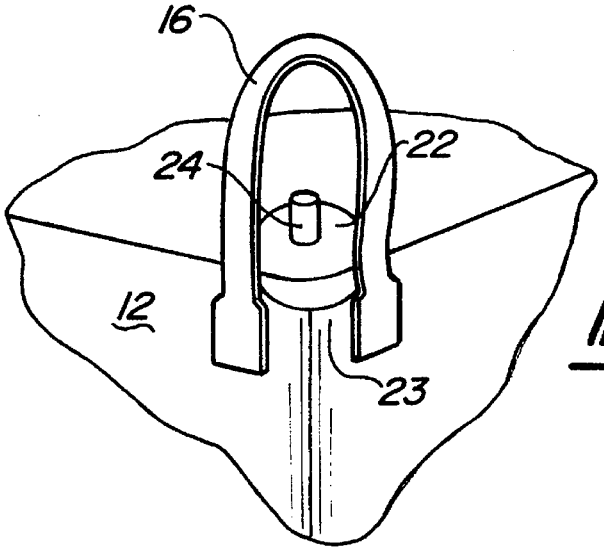
FIG. 3 is a schematic detail from FIG. 1 further illustrating a preferred position of the pressure relief valve.

In accordance with the invention, a pressure relief valve 22 is sewn, glued or welded into the bag fabric comprising the top 18 adjacent one corner 23. The pressure relief valve 22 has a connection 24 to a pipe or tube 26 (see FIG. 3) for ducting exhausted gases and entrained powder to a receiver.

As can be seen from FIG. 1, when the bag 10 is being filled the spout 20 is connected to a filling silo 28. The lifting loops 16 also help support the bag by being hooked onto support bard 27.

The silo may have a conventional closeable gate valve 25 at its lower end. Before or during the filling of the bag air or other gas such as nitrogen, under pressure from pump 29 is forced into the bag thereby inflating it, and filling of the pulverulent or powdery material commences. If the pressure within the bag exceeds the predetermined setting of the relief valve 22 (which should be chosen to be below the pressure at which air will be forced through the seams and stitching of the bag 10) excess air is ducted via a tube 26 back into the silo 28 so that any entrained powder is returned for re-use instead of being released into the atmosphere.

The silo may also be pressurized with inert gas from a operably connected supply 31. If so, a non-return valve 30 may be operably connected to the down-stream end of tube 26 at silo 28 to prevent the gas from backing up into tube 26. Alternatively, the tube 26 could be led to another suitable receiver whereby the entrained powder is kept out of the atmosphere surrounding the filling machine, or could even be vented to waste if circumstances dictate this.

Figure 4:
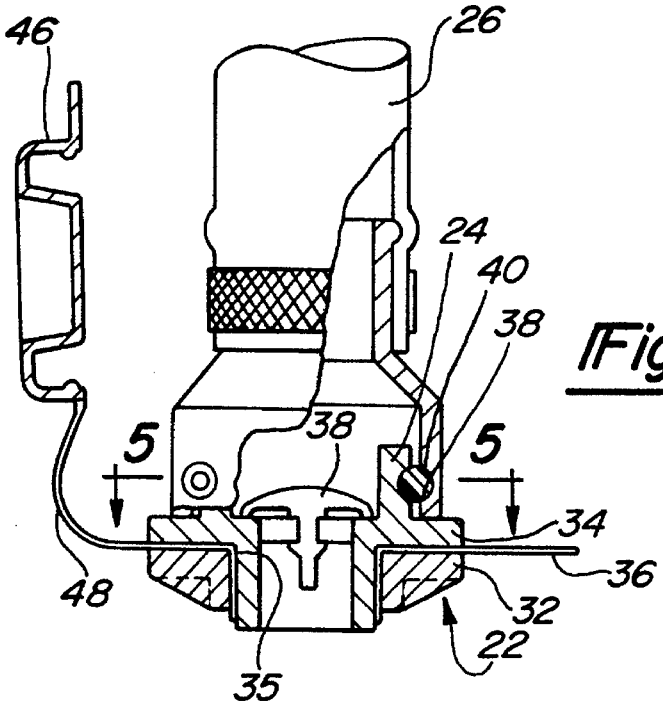
FIG. 4 is an enlarged cross-sectional view illustrating an embodiment of the pressure relief valve connection to the return tube.
Figure 5:
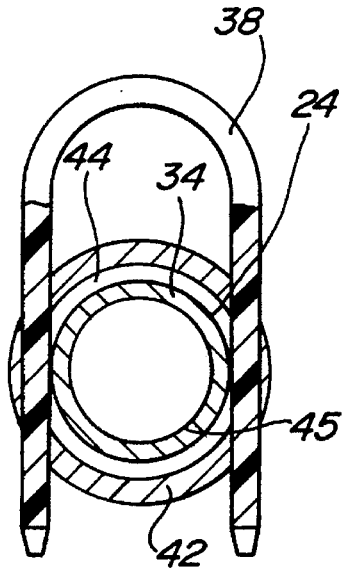
FIG. 5 is a cross sectional view taken along lines 5—5 shown in FIG. 1.
Figure 6:
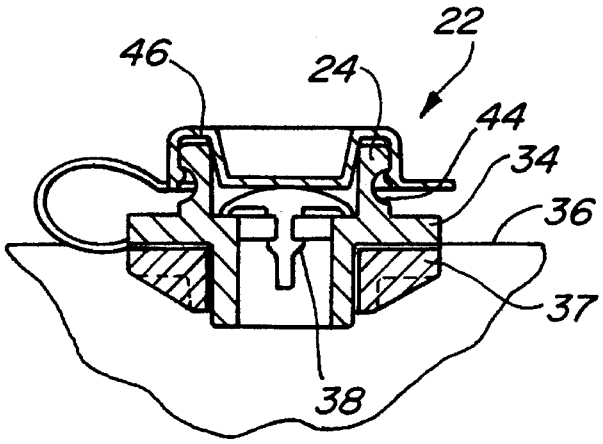
FIG. 6 is a cross-sectional view of the pressure relief valve shown in FIG. 5 after it is disconnected from the tube and capped.

As shown in FIGS. 4 and 6, the pressure relief valve 26 has a base member 32 and a top housing 34 that are connected together with the FIBC having a hole 35 and the fabric 36 about the hole 35 clamped therebetween. The housing 34 may contain a spring loaded check valve 38 that is normally closed as shown but can open when a pressure above set forth predetermined pressure is exerted thereon. As shown in FIGS. 4 and 5, the tube 26 is easily and sealingly coupled with the pressure relief valve via a connection 4 which includes a pin 38 that passes through apertures 40 in a end coupler 42 and engages a groove 44 in the top nozzle 45 of top housing 34.

The pressure relief valve 22 may also have a protective cap 46 that snap fits onto housing 34. The cap may have a strap 48 that is mounted to the FIBC via being clamped between base member 32 and housing 34.

When the bag is filled, the gate valve 25 is then closed, its filler spout 20 is easily decoupled from the filling silo 28, the pressure valve 22 is easily decoupled from the return tube 26, and the loops are unhooked from the support bars. The silo and return tube are then ready to be mounted to another empty FIBC for filling.

The FIBC of the invention provides a simple and economical solution to the problem of leakage at filling stations where high pressure inflation is employed.

In this fashion, a system provides for filling of a FIBC which may be made from fabric and sewn together without leakage of pulverulent material into the ambient atmosphere by assuring that the gasses and pulverulent material is returned from the FIBC to the supply silo. In this way, a system is devised to assure that the pressure within the FIBC does not exceed pressures that may cause the pulverulent material to be forced through the seams or stitching in the fabric during the filling process and thus reduce the chance that the ambient atmosphere become affected by the filling material during the fill operation.

Variations and modifications are possible without departing from the scope and spirit of the present invention as defined by the appended claims.

The embodiments in which an exclusive property or privilege is claimed are defined as follows:

1. A flexible intermediate container apparatus assembly adapted to contain a pulverulent material, said container apparatus assembly comprising:

a bag formed of a plurality of side walls, a base wall, and a top wall defining an interior space closed off from an exterior space of ambient atmosphere;

a pressure means for producing pressure within said bag above said ambient atmosphere;

a spout mounted on said top wall constructed to receive said pulverulent material housed in a filling apparatus that is closed from said exterior space of ambient atmosphere;

a pressure relief valve mounted on a wall of said bag and adapted to release gas and said pulverulent at a pressure lower than that which would cause the walls of said bag to rupture; and duct means being provided having one end thereof connected to said pressure relief valve to collect said pulverulent material which may escape from said pressure relief valve, and the other end sealingly positioned to deposit the escaped pulverulent material into a suitable receiver that is closed from ambient atmosphere such that said container system can fill said bag with no leakage of pulverulent material into said ambient atmosphere.

2. A flexible intermediate container apparatus assembly according to claim 1, wherein said bag is constructed from a woven fabric which is air and water resistant.

3. A flexible intermediate container apparatus assembly according to claim 2, wherein said fabric has a plastic material coating thereon.

4. A flexible intermediate container apparatus assembly according to claim 1, wherein a filling silo is both said filling apparatus and said suitable receiver.

5. A flexible intermediate container apparatus assembly according to claim 1, wherein said pressure relief valve is disposed at an edge of said top wall.

6. A method for filling a flexible intermediate container with a pulverulent material, said method comprising the steps of providing a container comprising a bag formed of a plurality of side walls, a base wall, and a top wall; a spout mounted on the top wall adapted to receive the pulverulent material from a filling apparatus; a pressure relief valve mounted on a wall of the bag and adapted to release gas and the pulverulent material at a pressure lower than that which would cause the walls of the bag to rupture, wherein duct means is provided having one end thereof connected to the pressure relief valve to collect the pulverulent material which may escape from the pressure relief valve, and the other end positioned to deposit the escaped pulverulent material into a suitable receiver that is closed to ambient atmosphere;

introducing a compressed gas into the spout; and introducing a pulverulent material into the spout from a filling silo positioned above the bag, thereby inflating the bag and filling the bag with the pulverulent material.

7. A method according to claim 6, wherein the compressed gas is introduced into the bag prior to the introduction of the pulverulent material.

8. A method according to claim 6, wherein the compressed gas is introduced into the bag simultaneously with the introduction of the pulverulent material.

9. A method according to claim 6, wherein one end of the duct means is connected to the filling silo, and wherein compressed gas and pulverulent material which escapes from the pressure relief valve is returned to the filling silo.

* * * * *